US006581557B1

(12) United States Patent
Gaessler et al.

(10) Patent No.: US 6,581,557 B1
(45) Date of Patent: Jun. 24, 2003

(54) VALVE CONTROL FOR AN INTERNAL COMBUSTION ENGINE

(75) Inventors: Hermann Gaessler, Vaihingen (DE); Udo Diehl, Stuttgart (DE); Karsten Mischker, Leonberg (DE); Rainer Walter, Pleidelsheim (DE); Stefan Franzl, Drancy (FR); Juergen Schiemann, Markgroeningen (DE); Christian Grosse, Kornwestheim (DE); Volker Beuche, Stuttgart (DE); Stefan Reimer, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 15 days.

(21) Appl. No.: 09/914,598

(22) PCT Filed: Nov. 10, 2000

(86) PCT No.: PCT/DE00/04014

§ 371 (c)(1),
(2), (4) Date: Jan. 16, 2002

(87) PCT Pub. No.: WO01/49981

PCT Pub. Date: Jul. 12, 2001

(30) Foreign Application Priority Data

Dec. 30, 1999 (DE) ..... 199 63 753

(51) Int. Cl.[7] ..... F01L 1/34
(52) U.S. Cl. ..... 123/90.15; 123/90.11
(58) Field of Search ..... 123/90.11, 90.12, 123/90.15, 90.16, 90.17

(56) References Cited

U.S. PATENT DOCUMENTS 3,727,595 A 4/1973 Links
4,009,695 A * 3/1977 Ule ..... 123/90.13
4,033,304 A * 7/1977 Luria ..... 123/78 A
4,696,265 A * 9/1987 Nohira ..... 123/90.16

FOREIGN PATENT DOCUMENTS

DE 20 06 304 A 8/1971
DE 196 23 698 A 12/1997
DE 196 41 244 A 4/1998

OTHER PUBLICATIONS

Patent Abstracts of Japan vol. 1998, No. 04, Mar. 31, 1998 & JP 09 329 9 A Dec. 22, 1997.

Patent Abstracts of Japan vol. 008, No. 253 (M–339) & JP 59 128971 A, Jul. 25, 1984.

Patent Abstracts of Japan vol. 017, No. 117 (M–1378), Mar. 11, 1993 & JP 04 301104 A, Oct. 23, 1992.

* cited by examiner

*Primary Examiner*—Thomas Denion
*Assistant Examiner*—Jaime Corrigan
(74) *Attorney, Agent, or Firm*—Michael J. Striker

(57) ABSTRACT

A timing gear for triggering a gas exchange valve for adjusting the output of an internal combustion engine through the opening and closing of the gas exchange valve and a method for triggering the gas exchange valve, where at least one of the opening and closing of the gas exchange valve is executed as a function of a delay interval when opening and/or closing the gas exchange valve and where in order to determine the delay time, the gas exchange valve is adjusted for the length of a predetermined adjustment interval and at least one of the opening and closing of the gas exchange valve is detected.

11 Claims, 3 Drawing Sheets

VALVE CONTROL FOR AN INTERNAL COMBUSTION ENGINE

The invention relates to a method and a timing gear for triggering a gas exchange valve for adjusting the output of an internal combustion engine through the opening and closing of the gas exchange valve, where the opening and/or closing of the gas exchange valve occur(s) as a function of a delay interval during the opening and/or closing the gas exchange valve, The object of the invention is to improve and simplify the adjustment of a gas exchange valve.

The object is attained according to the invention by means of a method according to claim 1 and a timing gear according to claim 12. The adjustment of the output of an internal combustion engine through the opening and closing of a gas exchange valve, where the opening and/or closing of the gas exchange valve occur(s) as a function of a delay interval during the opening and/or closing the gas exchange valve, and where in order to determine the delay interval, the gas exchange valve (1) is adjusted for the length of a predetermined adjustment interval and the opening and/or closing of the gas exchange valve (1) is detected.

In an advantageous embodiment of the invention, a signal to open the gas exchange valve is generated as a function of an opening delay interval between the beginning of the signal to open the gas exchange valve and the opening of the gas exchange valve, and the signal to open the gas exchange valve is emitted for the length of the predetermined adjustment interval.

In another advantageous embodiment of the invention, a signal to close the gas exchange valve is generated as a function of a closing delay interval between the beginning of the signal to close the gas exchange valve and the closing of the gas exchange valve, and the signal to close the gas exchange valve is emitted for the length of the predetermined adjustment interval.

In another advantageous embodiment of the invention, the adjustment interval is lengthened when no opening and/or closing of the gas exchange valve is detected.

In another advantageous embodiment of the invention, the adjustment interval is lengthened until an opening and/or closing of the gas exchange valve is detected.

In another advantageous embodiment of the invention, the opening delay interval and/or the closing delay interval is/are determined as a function of the adjustment interval when an opening and/or closing of the gas exchange valve is detected.

In another advantageous embodiment of the invention, the opening delay interval and/or the closing delay interval is/are set equal to the adjustment interval when an opening and/or closing of the gas exchange valve is detected.

In another advantageous embodiment of the invention, the opening delay interval and/or the closing delay interval for the gas exchange valve is/are determined independent of the opening delay interval and/or the closing delay interval of other gas exchange valves of the internal combustion engine.

In another advantageous embodiment of the invention, the opening delay interval and/or the closing delay interval for the gas exchange valve is/are determined between operating phases of the internal combustion engine.

In another advantageous embodiment of the invention, in order to determine the opening delay interval and/or the closing delay interval, the gas exchange valve is adjusted independent of an adjustment required by the operation of the internal combustion engine.

In another advantageous embodiment of the invention, the opening and/or closing of the gas exchange valve is detected by means of measuring structure-borne noise, airborne noise, air mass, cylinder-specific air mass, intake manifold pressure, and/or combustion chamber pressure.

Other advantages and details ensue from the subsequent description of exemplary embodiments.

Figure 1:
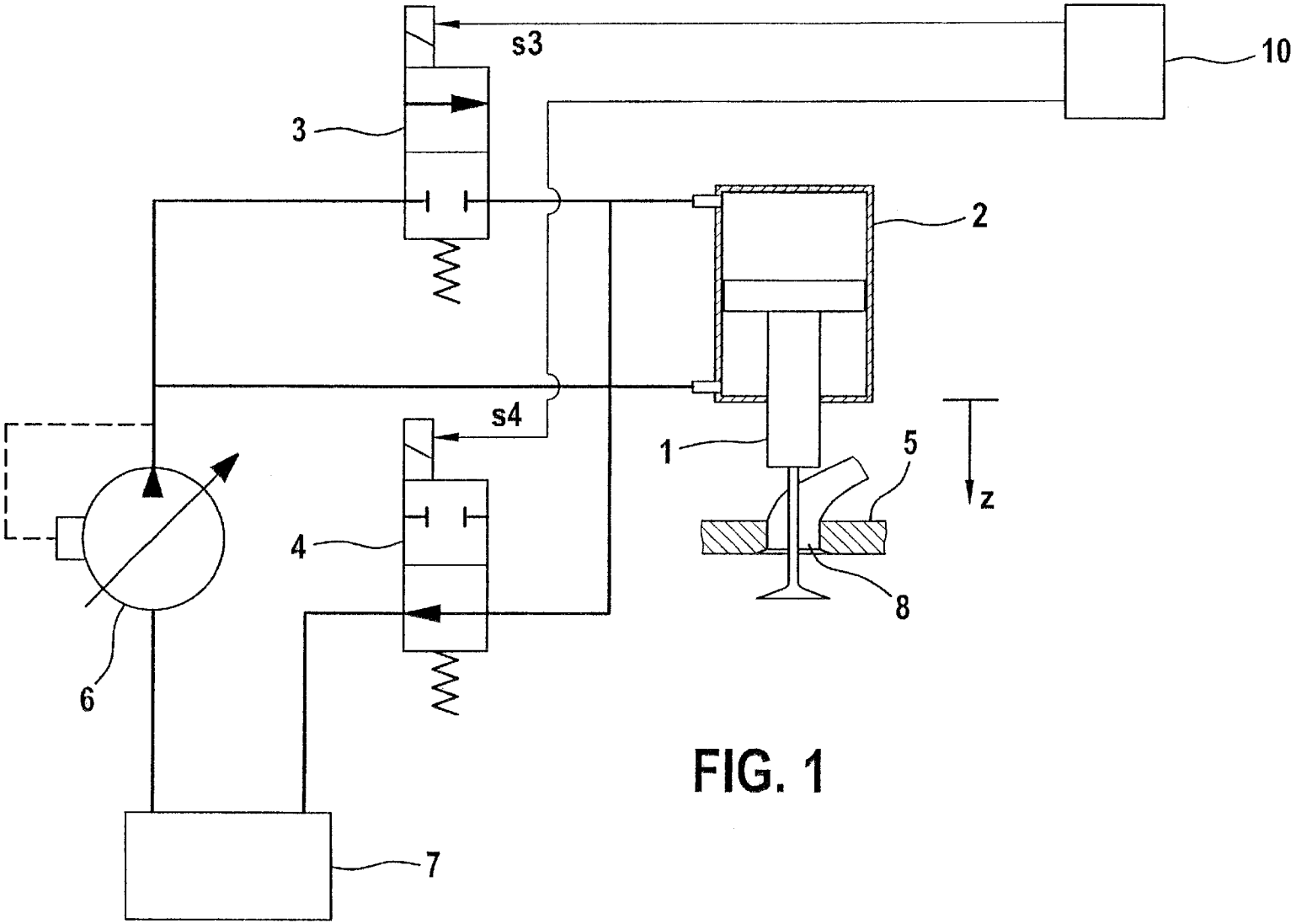
FIG. 1 shows a device for adjusting a gas exchange valve.

FIG. 1 shows a timing gear 10 for controlling an inlet valve 3 and an outlet valve 4 for adjusting a gas exchange valve 1 of an internal combustion engine. The gas exchange valve 1 is associated with a cylinder head 5. The gas exchange valve 1 opens or closes an opening 8 and consequently adjusts an air mass flow $m_i$ through the opening 8 into a cylinder of the internal combustion engine. In addition, a pump 6 is provided for pumping hydraulic fluid. The inlet valve 3 and the outlet valve 4 control the inlet and outlet of hydraulic fluid into and out of a hydraulic actuator 2 and the gas exchange valve 1 is moved as a result. If the inlet valve 3 is open and the outlet valve 4 is closed, then hydraulic fluid flows into the hydraulic actuator 2 in such a way that the valve moves in the direction z. However, if the inlet valve 3 is closed on the outlet valve 4 is open, hydraulic fluid flows out of the hydraulic actuator 2 in such a way that the gas exchange valve 1 moves in the direction -z. A reservoir 7 for hydraulic fluid is provided in order to receive hydraulic fluid flowing out of the outlet valve 4. The inlet valve 3 and the outlet valve 4 are controlled by signals s3 and s4 from the timing gear 10. To that end, the timing gear 10 is connected to a structure-borne noise sensor, an airborne noise sensor, an air mass sensor, an intake manifold pressure sensor, cylinder-specific air mass sensors, intake manifold pressure sensors, and/or combustion chamber pressure sensors, not shown.

Figure 2:
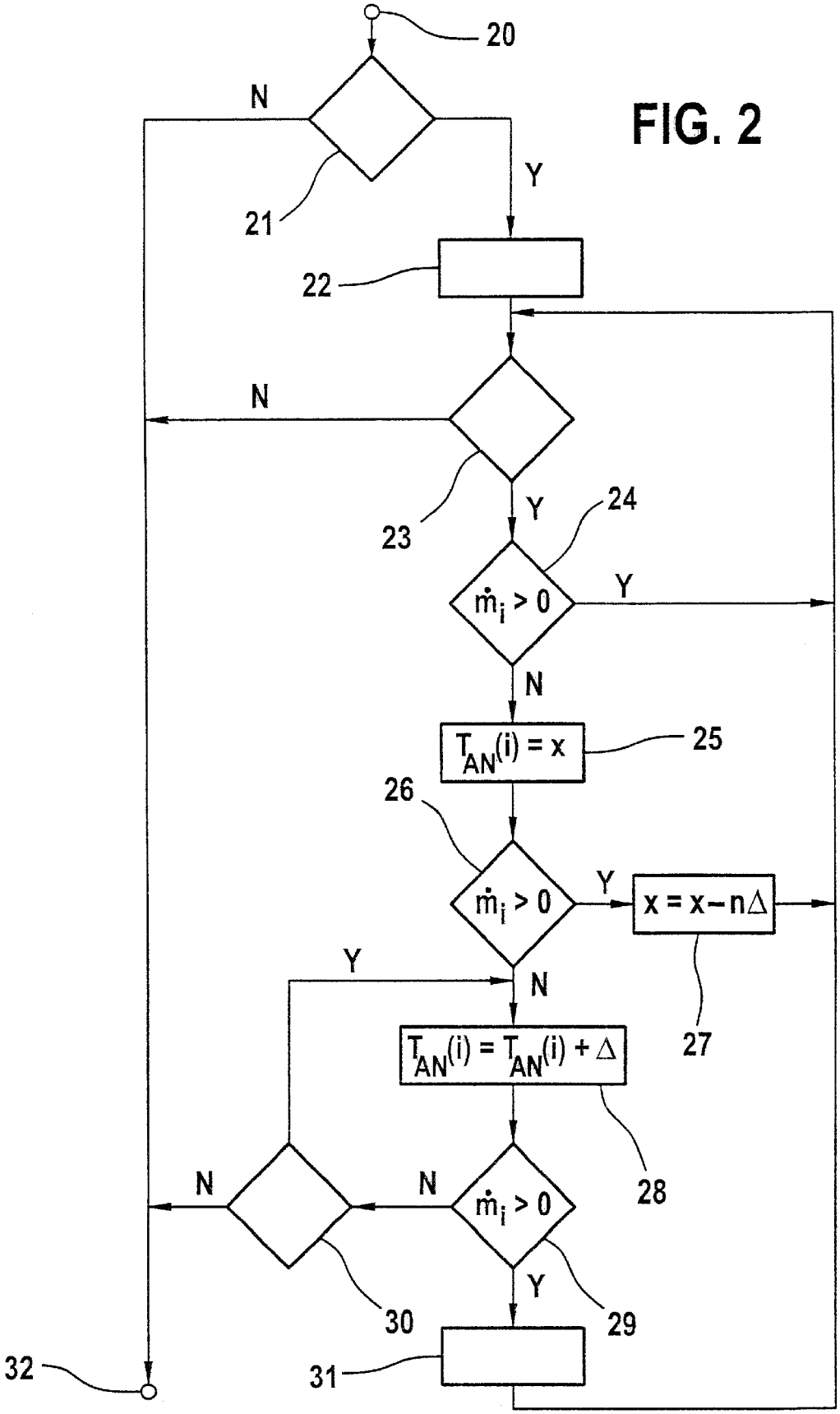
FIG. 2 shows a time diagram for controlling a gas exchange valve.

FIG. 2 shows a time diagram for determining the opening delay interval of the gas exchange valve 1, which in an exemplary embodiment, is implemented in the timing gear 10. In this diagram, the reference numeral 20 indicates the beginning of the process and the reference numeral 32 indicates the end of the process. After the beginning 20 of this process, a query 21 is made as to whether a so-called overrun has occurred. An overrun is understood to mean that the movement energy of a vehicle that can be driven by the internal combustion engine is moving the engine without fuel being burned in this engine. If an overrun is not occurring, then the program is ended. However, if an overrun is occurring, then an initialization step 22 is executed. In the initialization step 22, a determination is made as to which $i^{th}$ gas exchange valve of the internal combustion engine is the one whose opening delay interval should be ascertained.

The initialization step 22 is followed by another query 23. The query 23 asks whether an overrun is occurring and whether an overrun can be (advantageously e.g. with closed gas exchange valves) permitted. However, if no overrunning is occurring or if overrunning is not permissible, then the program is ended. However, if there is overrunning and if overrunning is permissible, then a query 24 is made as to whether the air mass flow $m_i$ through the opening 8 is greater than zero. If the air mass flow $m_i$ through the opening 8 is greater than zero, then the query 23 is made again. However, if the air mass flow $m_i$ through the opening 8 is not greater than zero, then a step 25 occurs.

Figures 3, 4, 5, 6, 7:
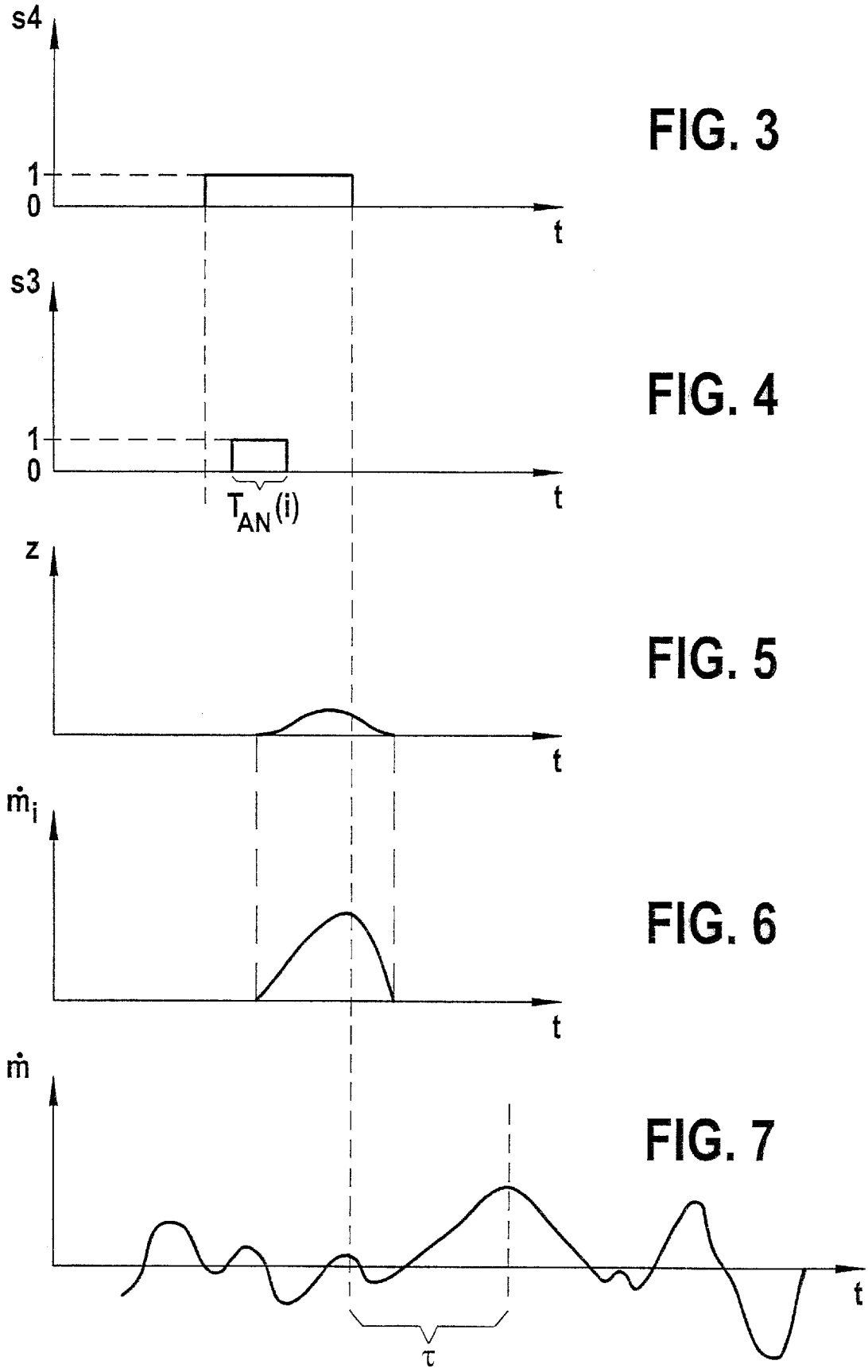
FIG. 3 shows a signal for an outlet valve.
FIG. 4 shows a signal for an inlet valve.
FIG. 5 shows the position of a gas exchange valve over time.
FIG. 6 shows an air mass flow over time.
FIG. 7 shows a total air mass flow over time.

In step 25, for the $i^{th}$ gas exchange valve, the delay interval $T_{AN}(i)$ is set equal to the value x: $T_{AN}(i)=x$. In addition, the gas exchange valve is adjusted for the length of an adjustment interval $T_{AN}(i)$. To this end, the outlet valve 4 is initially closed by the output of the signal s4, as shown for example in FIG. 3. Then, the inlet valve 3 is opened by the signal s3 for the length of the adjustment interval $T_{AN}(i)$, as shown in FIG. 4. FIGS. 3 and 4 show the signals s4 and s3 over time t. After the closing of the inlet valve 3, the outlet valve 4 is open again.

The step 25 is followed by a query 26, which corresponds to the query 24. That is, the query asks whether the air mass flow $m_i$ through the opening 8 is greater than zero. If the air mass flow $m_i$ through the opening 8 is greater than zero, then in a step 27, the value x is decreased by a value n?Δ. Here, n is a numerical value, e.g. 3, and Δ is an interval of time. The step 27 is followed by the query 23.

However, if the query 26 finds that the air mass flow $m_i$ through the gas exchange valve 1 and/or the opening 8 is not greater than zero, then a step 28 follows, in which the adjustment interval $T_{AN}(i)$ is increased by a value Δ. In addition, the gas exchange valve is adjusted for the length of the adjustment interval $T_{AN}(i)$ in the manner executed in step 25.

The step 28 is followed by a query 29 which corresponds to the queries 24 and 26. That is, the query asks whether the air mass flow $m_i$ through the opening 8 is greater than zero. If the air mass flow $m_i$ through the opening 8 is not greater than zero, then a query 30 is made as to whether an overrun is occurring and whether overrunning is permissible. The query 30 thus corresponds to query 23. If there is no (further) overrunning or if overrunning is not (or is no longer) permissible, then the program is ended. However, if an overrunning is occurring and overrunning is permissible, then step 28 is in turn executed.

However, if the query 29 finds that the air mass flow $m_i$ through the opening 8 is greater than zero, then a step 31 is executed. In step 31, the opening delay interval is set equal to the current adjustment time $T_{AN}(i)$ and then the adjustment interval $T_{AN}(i)$ is set to its initialization value (as in the initialization step 22). In addition, the value i is increased by 1 in step 31. If this new value i is greater than the number of gas exchange valves for which the above-described method is to be carried out, then i is set equal to 1. Step 31 is followed by the query 23. The time diagram according to FIG. 2 can also be used analogously for determining the closing delay interval of the gas exchange valve 1. In this connection, the gas exchange valve is closed for the length of an adjustment interval $T_{AN}(i)$, starting from the open state. With regard to the exemplary embodiment according to FIG. 1, this is assumed to be a definite time starting from the open state of the inlet valve 3 and starting from the closed state of the outlet valve 4. The inlet valve 3 is closed and then the outlet valve 4 is opened for the length of an adjustment interval $T_{AN}(i)$. The queries 26 and 29 should be replaced by the query as to whether m=zero.

FIGS. 3 to 7 show the exemplary embodiment according to FIG. 2. FIG. 5 shows the position z of the gas exchange valve 1 over time t in reaction to the signals s4 and s3 according to FIGS. 3 and 4. FIG. 6 shows the air mass flow $m_i$ through the opening 8 in FIG. 1. By measuring this air mass flow $m_i$, for example the queries 24, 26, and 29 in the time diagram according to FIG. 2 can be executed. The air mass flow $m_i$ through the opening 8 of an individual gas exchange valve 1 is difficult to measure. It is easier to measure the total air mass flow m through an air supply for a number of gas exchange valves. FIG. 7 shows an air mass flow m of this kind by way of example, where the air mass flow m is plotted over time t. Due to the distance between the gas exchange valve 1 and a sensor for measuring the total air mass flow m, the action of the opening of the gas exchange valve 1 on the total air mass flow m appears, delayed by a dead time t. Consequently, the opening of the gas exchange valve 1 can be detected to by evaluating the total air mass flow m. The valuation can take place, for example, in such a way that the total air mass flow m is monitored during a time window in which a reaction in the total air mass flow m is expected due to the opening of the gas exchange valve 1. Furthermore, it is possible to calculate the integral of the total air mass flow m and/or its average and to detect an increase in the integral and/or the average when the gas exchange valve 1 opens and consequently to detect an increase in the air mass flow $m_i$ through the opening 8.

It is also possible to detect the opening and/or closing of the gas exchange valve 1 by measuring structure-born noise, airborne noise, intake manifold pressure, and/or combustion chamber pressure. In this instance, the queries 24, 26, and 29 in the time diagram according to FIG. 2 must be replaced by the query as to whether the gas exchange valve is open and/or in the event of a measurement of structure-born noise, a query as to whether the gas exchange valve has come into contact with the valve seat.

What is claimed is:

1. A method for triggering a gas exchange valve (1) for adjusting the output of an internal combustion engine by opening and closing the gas exchange valve (1), where at least one of the opening and closing of the gas exchange valve (1) occur(s) as a function of a delay interval during at least one of the opening and closing the gas exchange valve (1), characterized in that in order to determine the delay interval, the gas exchange valve (1) is adjusted for the length of a predetermined adjustment interval ($T_{AN}$) and at least one of the opening and closing of the gas exchange valve (1) is detected, wherein at least one of the opening and closing of the gas exchange valve (1) is detected by at least one means of measuring structure-borne noise, airborne noise, air mass, intake manifold pressure, cylinder-specific air mass, cylinder-specific intake manifold pressure, and cylinder-specific combustion chamber pressure.

2. The method according to claim 1, where a signal to open the gas exchange valve (1) is generated as a function of an opening delay interval between the beginning of the signal to open the gas exchange valve (1) and the opening of the gas exchange valve (1), characterized in that the signal to open the gas exchange valve (1) is emitted for the length of the predetermined adjustment interval ($T_{AN}$).

3. The method according to claim 1, where a signal to close the gas exchange valve (1) is generated as a function of a closing delay interval between the beginning of the signal to close the gas exchange valve (1) and the closing of the gas exchange valve (1), characterized in that the signal to close the gas exchange valve (1) is emitted for the length of the predetermined adjustment interval ($T_{AN}$).

4. The method according to claim 1, characterized in that the adjustment interval ($T_{AN}$) is lengthened when no at least one opening and closing of the gas exchange valve (1) is detected.

5. The method according to claim 1, characterized in that the adjustment interval ($T_{AN}$) is lengthened until at least one of an opening and closing of the gas exchange valve (1) is detected.

6. The method according to claim 1, characterized in that at least one of the opening delay interval and closing delay interval is determined as a function of the adjustment interval when at least one of an opening and closing of the gas exchange valve (1) is detected.

7. The method according to claim 1, characterized in that at least one of the opening delay interval and the closing delay interval is set equal to the adjustment interval when at least one of an opening and closing of the gas exchange valve (1) is detected.

8. The method according to claim 1, characterized in that at least one of the opening delay interval and the closing delay interval for the gas exchange valve (1) is determined independent of at least one of the opening delay interval and the closing delay interval of other gas exchange valves of the internal combustion engine.

9. The method according to claim 1, characterized in that at least one of the opening delay interval and the closing delay interval for the gas exchange valve (1) is determined between operating phases of the internal combustion engine.

10. The method according to claim 1, characterized in that in order to determine at least one of the opening delay interval and the closing delay interval, the gas exchange valve (1) is adjusted independent of an adjustment required by the operation of the internal combustion engine.

11. A timing gear (10) for triggering a gas exchange valve (1) for adjusting the output of an internal combustion engine through the opening and closing of the gas exchange valve (1), in accordance with a method according to claim 1, where at least one of the opening and closing of the gas exchange valve (1) occurs as a function of a delay interval during the at least one of an opening and closing of the gas exchange valve (1), characterized in that in order to determine at least one of the opening delay interval and the closing delay interval, the timing gear (10) adjusts the gas exchange valve (1) for the length of a predetermined adjustment interval ($T_{AN}$) and detects at least one of the opening and closing of the gas exchange valve (1)), and wherein at least one of the opening and closing of the gas exchange valve (1) is detected by at least one means of measuring structure-borne noise, airborne noise, air mass, intake manifold pressure, cylinder-specific air mass, cylinder-specific intake manifold pressure, and cylinder-specific combustion chamber pressure.

* * * * *